United States Patent [19]

Karrfalt et al.

[11] Patent Number: 4,996,803

[45] Date of Patent: Mar. 5, 1991

[54] ROOFING SYSTEMS AND INSULATION ATTACHMENT METHOD

[75] Inventors: Henry A. Karrfalt, Noblesville; Mark R. Easter, Indianapolis, both of Ind.

[73] Assignee: Bridgestone/Firestone, Inc., Akron, Ohio

[21] Appl. No.: 392,230

[22] Filed: Aug. 10, 1989

[51] Int. Cl.[5] ..... E04B 7/00

[52] U.S. Cl. ..... 52/96; 52/411; 52/420; 52/746; 52/747; 52/63; 52/410

[58] Field of Search ..... 52/746, 411, 420, 419, 52/408, 309.4, 404, 96, 63, 747, 410; 156/71; 428/317.3

[56] References Cited

U.S. PATENT DOCUMENTS

| | | | |
|---|---|---|---|
| 3,173,826 | 3/1965 | Campbell et al. | 428/317.3 X |
| 3,468,086 | 9/1969 | Warner | 52/173 |
| 3,708,379 | 1/1973 | Flint | 161/36 |
| 3,900,999 | 8/1975 | Callan | 52/744 |
| 4,021,981 | 5/1977 | Van Wagoner | 52/746 X |
| 4,073,997 | 2/1978 | Richards et al. | 156/71 X |
| 4,320,605 | 3/1982 | Carlson et al. | 52/309.4 X |
| 4,536,423 | 8/1985 | Travis | 156/71 X |
| 4,620,402 | 11/1986 | Beneze | 52/506 X |
| 4,688,361 | 8/1987 | Kelley | 52/173 R |
| 4,736,927 | 6/1988 | Thuresson | 248/205.3 |

FOREIGN PATENT DOCUMENTS

| | | | |
|---|---|---|---|
| 3615466 | 11/1987 | Fed. Rep. of Germany | 52/746 |
| 8402574 | 3/1986 | Netherlands | 428/317.3 |
| 926735 | 5/1963 | United Kingdom | 428/317.3 |

*Primary Examiner*—James L. Ridgill, Jr.
*Attorney, Agent, or Firm*—Ronald Brietkrenz

[57] ABSTRACT

A roofing system and method of securing insulation board to a roof deck free of mechanical fasteners includes the deck, a plurality of the insulation boards, and a flexible waterproof membrane which covers the boards. First and second embodiments of the invention include flexible polyisobutylene pads and strips respectively, which have opposite top and bottom pressure sensitive adhesive surfaces. A plurality of the pads are adhered to the insulation boards by their adhesive top surface at locations where mechanical fasteners otherwise would be necessary to secure the boards to the roof deck. A pair of the strips are adhered to the boards by their adhesive top surface at spaced locations. After removal of a release sheet from the bottom surface of the pads or strips, the boards are placed and pressed on the roof deck, and the exposed adhesive secures the boards to the deck free of mechanical fasteners. A flexible waterproof membrane then is placed over the insulation boards and is either mechanically fastened to the roof deck independent of the insulation boards, or is adhesively attached to the boards.

12 Claims, 2 Drawing Sheets

ROOFING SYSTEMS AND INSULATION ATTACHMENT METHOD

BACKGROUND OF THE INVENTION

1. Technical Field

The invention relates to roofing systems and methods of securing insulation to roof decks, and in particular to such a system and method which secures insulation boards to a roof deck free of mechanical fasteners. More particularly, the invention relates to such a system and method in which a flexible waterproof membrane covers the secured insulation boards to provide a weatherproof roof covering.

2. Background Information

Pressure sensitive adhesive tapes have been used in the roofing industry primarily for adhering together flexible roof membrane seams or to adhere the flexible membrane to attaching devices. However, the insulation boards placed between the roof deck and the roof membrane traditionally have been mechanically attached to the roof deck by screws and plates, or sometimes have been secured with hot asphalt.

Mechanical fastening of insulation boards to a roof deck, although effective for securely attaching the insulation thereto, nevertheless requires an external power source for operating tools needed to complete the fastening operation, involves numerous steps from start to finish of the job, and is labor-intensive. Thus, mechanical fastening of insulation boards to a roof deck is a relatively expensive, time-consuming project. Also this use of mechanical fasteners provides a path from the exterior of the roof to the building interior for the undesirable passage of heat and cold known as thermal bridging.

The hot asphalt method of attachment has several disadvantages, most notably that hot asphalt damages or does not adhere to some insulation board types, and currently violates certain building code requirements as a fire hazard. In addition, asphalt attachment is relatively expensive, time-consuming, and messy since it requires kettles fired by fuel and mops for applying the asphalt to the roof deck.

U.S. Pat. No. 3,468,086 discloses a prefabricated roofing construction in which edges of roofing panels are provided with an adhesive material which is located on a foldable tape portion which is unfolded to overlay an adjacent section and to attach the sections to each other.

U.S. Pat. No. 3,708,379 discloses an elastomeric tape in which each of two bands comprises a portion of the elastomer and of the curing system. The elastomeric tape preferably is made of uncured copolymer elastomer, such as butyl rubber. In addition to butyl rubber and curing system components, the bands of the tape may contain plasticizers, fillers and pigments.

U.S. Pat. No. 3,900,999 discloses a rubber compound wherein a two-component polymeric tape is produced. A partially vulcanized butyl rubber can be used as the second component of the tape.

U.S. Pat. No. 4,736,917 discloses an attachment device for insulation wherein a double sided adhesive tape is attached to a plate and a protective film on one side of the tape is removed when the device is applied to a wall.

The closest known prior art to the present invention is disclosed in U.S. Pat. No. 4,688,361. This patent discloses a plurality of plates which are mechanically fastened to an underlying roof deck for holding down insulation boards positioned between the deck and plates. Also, the plates contain an adhesive which adheres to the underside of an overlying rubber roof membrane for holding the membrane in position. However, this patent does not disclose the use of flexible pads or strips, preferably formed of butyl rubber, which contain a pressure sensitive adhesive, positioned beneath insulation boards for securing the boards to a roof deck without using mechanical fasteners.

Thus, the need exists for an improved roofing system and method of securing insulation board to roof decks, without using mechanical fasteners.

SUMMARY OF THE INvENTION

Objectives of the present invention include providing a roofing system and method of securing insulation to roof decks in which insulation boards are securely attached to a roof deck free of mechanical fasteners.

Another objective of the present invention is to provide such a system and method which is effective in preventing curling or displacement of the insulation boards whether a flexible roof membrane covering the insulation is independently mechanically secured to the deck or adhesively attached to the insulation.

A further objective of the present invention is to provide a relatively inexpensive, simple, fast and efficient roofing system and method of securing insulation to roof decks wherein no tools or external power for operating the same, or excessive labor are required, and the use of mechanical fasteners are eliminated to prevent thermal bridging.

Still another objective of the invention is to provide a roofing system and method which complies with existing building code requirements, and which can be used with virtually all insulation types.

A still further objective of the present invention is to provide such a roofing system and method in which attachment of the insulation to the roof deck can be accomplished in a clean, orderly manner, and which does not pose health or fire hazards either during or after installation.

Still another objective of the present invention is to provide such a roofing system and method in which the insulation boards can be placed parallel or transverse to flutes formed in the roof deck without effecting the securing capabilities of the method.

A still further objective of the present invention is to provide such a roofing system and method which can be used to attach the insulation boards to different types of roof decks including those formed of metal or structural concrete.

These objectives and advantages are obtained by the improved method of the invention, the general nature of which may be stated as a method for securing an insulation board to a roof deck free of mechanical fasteners, including the steps of providing a plurality of flexible members having a pair of opposite facing surfaces each having an area of a pressure sensitive adhesive; applying the pads at certain locations on the insulation board, wherein the pads are adhered thereto by the adhesive area on a selected one of the opposite surfaces of the pads; and placing and pressing the insulation board onto the roof deck, so that the adhesive area on the other of the opposite surfaces of the pads contacts the roof deck to secure the board to the deck free of mechanical fasteners.

The objectives and advantages are further obtained by the improved roofing system of the invention, the general nature of which may be stated as including a rigid deck, a plurality of insulation boards secured to the deck by a plurality of flexible attachment members, the members having a pair of opposite surfaces containing an area of a pressure sensitive adhesive, wherein the adhesive area on a selected one of the opposite surfaces of the attachment members adheres the members to certain locations on the insulation boards, and the adhesive area on the other of the opposite surfaces of the attachment members contacts the rigid deck to secure the insulation boards to the deck free of mechanical fasteners; and a flexible waterproof membrane covering the insulation boards.

BRIEF DESCRIPTION OF THE DRAWINGS

Preferred embodiments of the invention, illustrative of the best modes in which applicants have contemplated applying the principles, are set forth in the following description and are shown in the drawings and are particularly and distinctly pointed out and set forth in the appended claims.

Similar numerals refer to similar parts throughout the drawings.

DESCRIPTION OF THE PREFERRED EMBODIMENT

Figure 1:
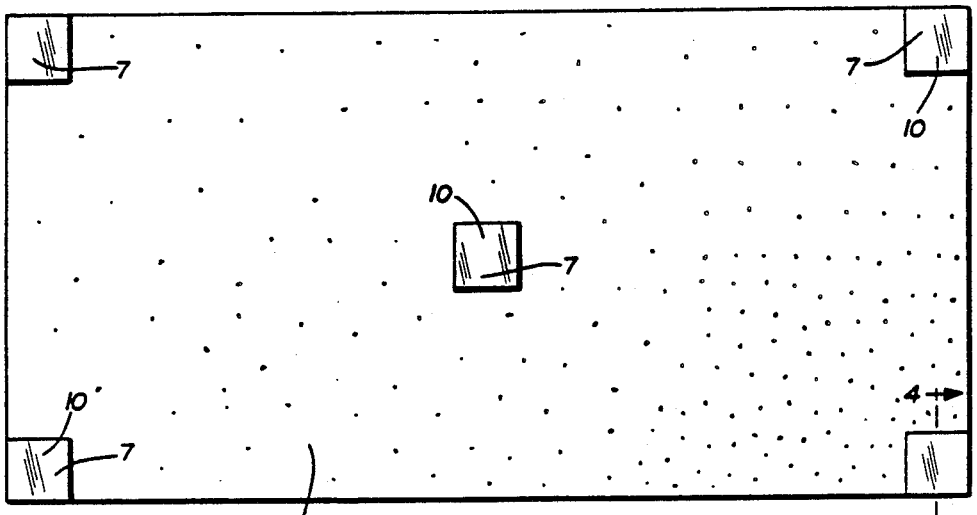
FIG. 1 is a bottom plan view of a first embodiment of the present invention, showing an insulation board having a plurality of polyisobutylene tape pads adhere thereto.
Figure 2:
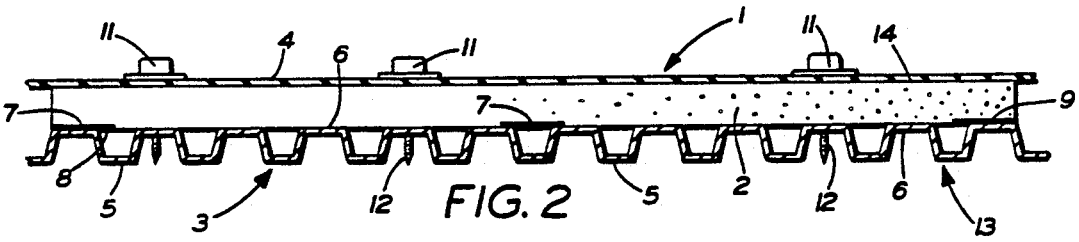
FIG. 2 is a fragmentary side view, partially in section, showing the insulation board of FIG. incorporated into a roof system, wherein the board is adhesively secured to a roof deck by its tape pads, and covered with a waterproof rubber membrane which is mechanically fastened to the roof deck by screws and plates.
Figure 3:
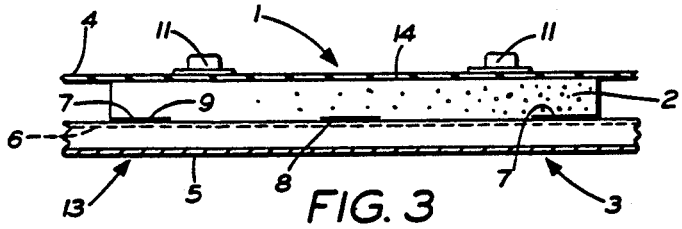
FIG. 3 is a fragmentary end view, partially in section, of the roof system of FIG. 2.

First and second embodiments of the improved roofing system of the present invention containing insulation boards secured to roof decks free of mechanical fasteners are shown in FIGS. 1–4 and 5–7, and are indicated generally at 1 and 20, respectively. The improved method of securing an insulation panel or insulation board 2 to a rigid roof deck which is indicated generally at 3, is incorporated into the improved roofing system of the invention. Roofing system 1 includes three main components, namely, roof deck 3, a plurality of insulation boards 2, and a flexible waterproof membrane 4 which covers boards 2, all of which are of a type individually well-known in the art. Insulation board 2 usually is provided in generally flat sheets having dimensions of 4 feet × 8 feet (FIG. 1). Roof deck 3 is formed by a plurality of metal panels 13 each having a plurality of alternating flutes or grooves 5 and ridges 6 (FIG. 2). Flexible membrane 4 is formed of rubber or an elastomeric material and provides a waterproof overlay for the roof system (FIG. 3). Panels 13 in turn are generally attached to supporting roof trusses or the like (not shown) of a type well-known in the art.

In accordance with one of the main features of the present invention, roof system 1 includes a plurality of flexible tape pads 7, preferably formed of polyisobutylene, in 6 inch × 6 inch squares. Most products formed primarily of the compound polyisobutylene are commonly referred to as "butyl rubber". Polyisobutylene, is a naturally tacky compound, having pressure sensitive adhesive properties but may contain additives to further increase the tackiness thereof, if desired. Polyisobutylene is a solid adhesive which does not run, emit fumes, or pose a fire hazard. Thus, pads 7 have a pair of opposite top and bottom surfaces 8 and 9, respectively (FIG. 4), which have sufficient material tackiness to provide pressure sensitive adhesive characteristics. The terms "top" and "bottom" refer to the position that the pads assume when placed upon roof deck 3, as shown in FIGS. 2 and 3. One type of tape pads 7 found suitable is distributed under the mark Quick Seam Splice Tape by The Firestone Tire and Rubber Company and identified as its part number FAC-1903.

Figure 4:
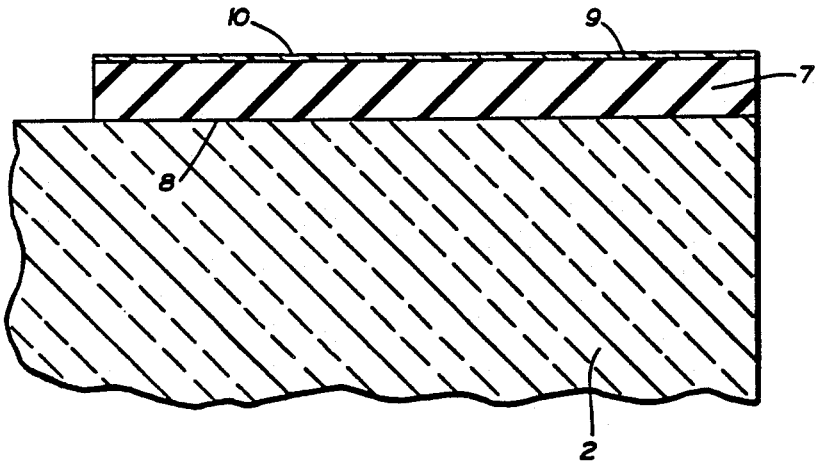
FIG. 4 is a greatly enlarged sectional view taken on line 4—4, FIG. 1.

A protective release sheet or paper 10 is applied to bottom surface 9 of each pad 7 of those pads which are applied to the insulation boards at the site of board manufacture for subsequent attachment at a job site to the roof deck (FIG. 4). These pads adhere to the bottom surface of boards 2 by the adhesive of top surface 8. Release paper 10 preferably is a type of silicone treated paper well-known in the art. Thus, it can be seen that release paper 10 will prevent adhesive bottom surface 9 of each pad 7 from being exposed and possibly adhering to undesired items during storage, shipping and handling prior to application of boards 2 to a roof deck 3. Alternatively, pads 2 may have a release paper (not shown) attached to both the top and bottom surfaces 8 and 9 thereof when the pads will be stored, shipped and handled prior to application to boards 2 by a roof installer at a job site. In accordance with the invention, pads 7 are adhered to insulation boards 2 at locations where mechanical fasteners otherwise would be necessary to secure the boards to a roof deck 3, as recommended by the manufacturer of the particular type of insulation board 2 being used. For example, a pad is attached to each corner of board 2 and at the center thereof as shown in FIG. 1.

Insulation boards 2 are securely attached to roof deck 3 as shown particularly in FIGS. 2 and 3. Release paper 10 is removed from bottom surface 9 of pads 7 of insulation boards 2 and the boards are placed on roof deck 3. Insulation boards 2 then are pressed into place and bottom surfaces 9 of pads 7 securely adhere to ridges 6 of roof deck 3 due to the flexible, pressure sensitive adhesive characteristic of the pads. The 6 inch × 6 inch preferred size of tape pads 7, ensures that each pad will contact at least one or an adjacent pair of ridges 6 of roof deck 3, since flutes 5 typically have a maximum 3 inch spacing. It is understood that rectangular boards 2 can be placed along or transverse to flutes and ridges 5 and 6 of metal panels 13 without effecting the concept of the invention.

Subsequent to securing insulation boards 2 to roof deck 3, an elastomeric waterproof membrane 4 is placed over top surface 14 of boards 2 and is securely attached to roof deck 3 independent of boards 2, by a plurality of mechanical fasteners, such as cap plates and screws 11 and 12, respectively (FIGS. 2 and 3). There are various types of penetrating mechanical fasteners which can be used for securing the membrane to the roof deck such as shown in U.S. Pat. Nos. 4,620,402 and 4,630,422. Since membrane 4 is independently attached to roof deck 3, the number of tape pads 7 needed to secure boards 2 to the roof deck 3 can be limited, and placed in locations where the insulation board manufacturer recommends installation of mechanical fasteners, as discussed above. Pads 7 will secure boards 2 to roof deck 3 sufficiently to prevent the boards from curling or becoming displaced underneath roof membrane 4 from causes such as high wind, temperature changes, etc.

Figure 5:
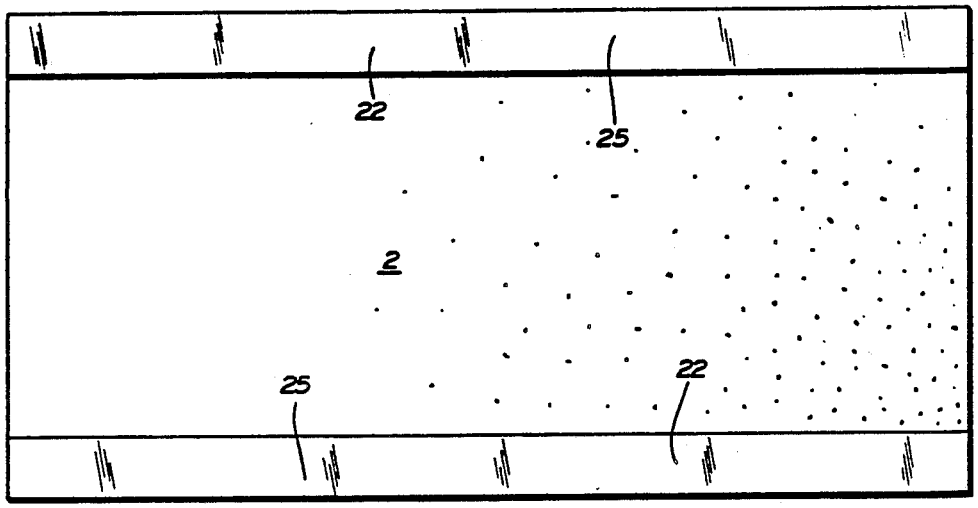
FIG. 5 is a bottom plan view of a second embodiment of the invention, showing an insulation board having a pair of polyisobutylene tape strips adhered thereto.
Figure 6:
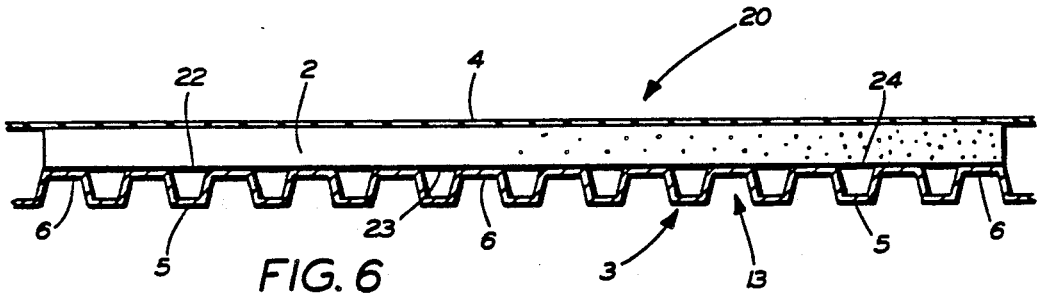
FIG. 6 is a fragmentary side view, partially in section, showing the insulation board of FIG. 5 incorporated into a roof system, wherein the board is adhesively secured to a roof deck by its tape strips, and covered with a waterproof rubber membrane which is adhesively attached to the board.
Figure 7:
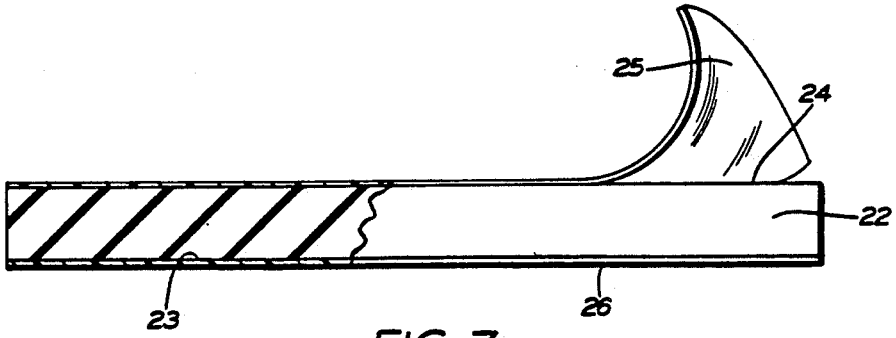
FIG. 7 is a greatly enlarged fragmentary view of a tape strip, with portions broken away and in section, showing a release sheet being removed prior to application of the strip to an insulation board.

Second embodiment 20 (FIGS. 5–7) of the present invention includes a pair of flexible tape strips 22 also preferably formed of polyisobutylene or butyl rubber in 6 inch × 8 foot strips (FIG. 5). Strips 22 each have a pair of opposite top and bottom pressure sensitive adhesive surfaces 23 and 24, respectively (FIG. 7). As with pads 7, strips 22 can be provided with a release paper 25 only on bottom surface 24 for those applications where strips 22 are applied to insulation boards 2 at the site of manufacture by adherence of pressure sensitive adhesive top surface 23.

Alternatively, release paper 25 can be applied to bottom surface 24 of strips 22 in addition to a release paper 26 being applied on top surface 23, where strips 22 will be shipped in roll form to the roof installer for subsequent attachment to insulation boards 2 at the job site. A pair of strips 22 preferably is applied to each board 2 at spaced locations along the longitudinal edges of the board, and should cover at least 20 percent of the area of a surface of the insulation board on which the strips are applied. It is understood that the ratio of 20% will be achieved using a pair of strips having dimensions of 6 inches by 8 feet on a usual 4 foot × 8 foot insulation panel. This ratio ensures a more secure attachment of the insulation boards to a roof deck than that provided by pads 7, which is desirable in a roofing system where overlying membrane 4 is adhesively attached to boards 2 rather than mechanically fastened to deck 3 as in roofing system 1.

Insulation boards 2 having strips 21 applied thereto are securely attached to a roof deck 3 by the same method described above for pads 7. The preferred 6 inch width of strips 22 ensures that the strips will contact at least one or an adjacent pair of ridges 6 of roof deck 3, regardless of whether boards 2 are placed along or transverse to flutes 5 and ridges 6 to provide for secure attachment of the boards thereon.

Subsequent to securing insulation boards 2 to roof deck 3, elastomeric waterproof membrane 4 is placed over boards 2 and is securely attached to the insulation boards by any suitable adhesive. Thus, the secure attachment of membrane 4 is dependent upon the secure attachment of insulation boards 2 to roof deck 3 (FIG. 6). The adhesive coverage provided by tape 22 of at least 20% of the area of insulation board 2 ensures such secure attachment.

Again, one of the important features of the present invention is the manner in which insulation board is secured to a roof deck without using mechanical fasteners, but rather using a flexible pressure sensitive adhesive tape which can be installed quickly and inexpensively by hand, and which eliminates thermal bridging. Preferably, the adhesive is provided by the natural tackiness of the polyisobutylene or butyl rubber from which the pads and strips are formed but could be provided by application of other types of pressure sensitive adhesives applied to flexible strips of material.

In summary, the improved method and system of the invention is effective in preventing curling or displacement of insulation boards between rubber roof overlayment membranes and a roof deck regardless of whether the membrane is independently mechanically fastened to the roof deck or adhesively attached to the insulation. Moreover, the pads and strips of the roofing system which secure the boards to a roof deck preferably are formed of the flexible, solid, pressure sensitive adhesive polyisobutylene which is stable, clean, fume free, safe, and within building code requirements. In addition, polyisobutylene will adhere to virtually all insulation types and roof deck types, including metal and structural concrete.

Accordingly, the improved roofing system and method of securing insulation to roof decks is simplified, provides an effective, safe, inexpensive, and efficient method and system which achieves all the enumerated objectives, provides for eliminating difficulties encountered with prior methods and systems, and solves problems and obtain new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the method steps of the improved method of securing insulation to roof decks and the manner in which the improved roofing system is constructed and used, the characteristics of the method steps and construction, and the advantageous, new and useful results obtained; the new and useful structures, devices, elements, arrangements, parts, combinations, and method steps are set forth in the appended claims.

We claim:

1. A method of forming a waterproof roof for a roof deck including the steps of:

(a) providing a plurality of rectangular shaped insulation boards having top and bottom surfaces;

(b) providing a plurality of flexible members formed of a butyl rubber compound having a natural tackiness and pressure sensitive adhesive properties, and having opposite top and bottom surfaces and a removable release sheet covering at least the bottom surface of said members;

(c) applying the members at certain locations on the bottom surfaces of the insulation boards including the corner, wherein said members are adhered thereto by the natural tackiness of the top surfaces of said members, with the majority of the bottom surfaces of the insulation boards being free of said members;

(d) removing the release sheets form the bottom surfaces of the members;

(e) placing and pressing the insulation boards onto the roof deck, so that the natural tackiness of the bottom surfaces of the members contact the roof deck to secure the boards at least at their corners to said deck free of mechanical fasteners, to prevent the corners of the boards from curling; and (f) securing a flexible waterproof membrane to the top surfaces of the insulation boards to cover said boards and form a waterproof covering over the roof deck.

2. The method defined in claim 1 including the step of mechanically fastening the flexible waterproof membrane to the roof deck.

3. The method defined in claim 1 including providing the flexible members as pads formed primarily of polyisobutylene.

4. The method defined in claim 3 including the step of providing a plurality of the pads each having dimensions greater than three inches square.

5. The method defined in claim 1 including providing the flexible members as strips formed primarily of polyisobutylene.

6. The method defined in claim 5 including the step of adhesively attaching a flexible waterproof membrane to the insulation boards to cover said boards.

7. The method defined in claim 5 including the step of applying a pair of the strips at spaced locations along a pair of longitudinal edges of each of the insulation boards.

8. The method defined in claim 5 in which the pair of strips cover approximately twenty percent of the area of the bottom surface of certain of the insulation boards, with each of the strips having a width of at least three inches.

9. A waterproof roofing system including, a rigid deck; a plurality of flexible attachment members having opposite top and bottom surfaces and formed of a butyl rubber compound having a natural tackiness and pressure sensitive adhesive properties; a plurality of rectangular shaped insulation boards having top and bottom surfaces with the natural tackiness of the top surfaces of the members adhering at certain locations on the bottom surfaces of the insulation boards including the corners, and the natural tackiness of the bottom surfaces of the members contacting the roof deck to secure the insulation boards to said roof deck free of mechanical fasteners and to prevent the corners of the boards from curling, with the majority of the bottom surfaces of the insulation boards being free of said members; and a flexible waterproof membrane secured to the top surfaces of the insulation boards to form a waterproof covering over the deck.

10. The system defined in claim 9 in which the flexible members are strips and cover at least approximately twenty percent of the area of the bottom surface of certain of the insulation boards; and in which the strips each have a width of at least three inches.

11. The system defined in claim 9 in which the flexible members are pads formed primarily of polyisobutylene.

12. The system defined in claim 11 in which the pads each have dimensions of greater then three inches square.

* * * * *